US009833089B2

(12) United States Patent
Choi

(10) Patent No.: US 9,833,089 B2
(45) Date of Patent: Dec. 5, 2017

(54) WEANING CLIP

(71) Applicant: Joon Hyuk Choi, Daegu (KR)

(72) Inventor: Joon Hyuk Choi, Daegu (KR)

( * ) Notice: Subject to any disclaimer, the term of this patent is extended or adjusted under 35 U.S.C. 154(b) by 0 days.

(21) Appl. No.: 15/030,177

(22) PCT Filed: Oct. 17, 2014

(86) PCT No.: PCT/KR2014/009782
§ 371 (c)(1),
(2) Date: Apr. 18, 2016

(87) PCT Pub. No.: WO2015/057011
PCT Pub. Date: Apr. 23, 2015

(65) Prior Publication Data

US 2016/0235228 A1 Aug. 18, 2016

(30) Foreign Application Priority Data

Oct. 18, 2013 (KR) ..... 10-2013-0124947

(51) Int. Cl.

| | |
|---|---|
| ***A47G 19/22*** | (2006.01) |
| ***A47G 21/18*** | (2006.01) |
| ***B65D 41/04*** | (2006.01) |
| ***B65D 45/32*** | (2006.01) |

(52) U.S. Cl.
CPC ..... *A47G 19/2272* (2013.01); *A47G 19/2266* (2013.01); *A47G 21/18* (2013.01); *B65D 41/04* (2013.01); *B65D 45/32* (2013.01)

(58) Field of Classification Search
CPC ..... A47G 19/2272; A47G 19/2266; A47G 21/18; B65D 41/04; B65D 45/32; B65D 1/023; B65D 1/0246; B65D 51/28; B65D 39/00
USPC ... 215/229, 228, 388, 387, 329, 316, 44, 43, 215/364, 355, 11.5, 11.4, 11.1; 220/709, 220/707, 705, 212, 288, 521
See application file for complete search history.

(56) References Cited

U.S. PATENT DOCUMENTS

2011/0049169 A1 3/2011 Rosnak et al.

FOREIGN PATENT DOCUMENTS

| | | | |
|---|---|---|---|
| JP | 11-240550 | A | 9/1999 |
| JP | 2003-054601 | A | 2/2003 |
| KR | 20-0161447 | Y1 | 12/1999 |
| KR | 20-0453033 | Y1 | 4/2011 |
| KR | 20-0464831 | Y1 | 1/2013 |

*Primary Examiner* — Robert J Hicks
(74) *Attorney, Agent, or Firm* — Novick, Kim & Lee, PLLC; Jae Youn Kim

(57) ABSTRACT

The present invention relates to a weaning clip and, more particularly, to a weaning clip which can be used not only by infants or handicapped people, but also by people from all walks of life, which is mounted on a bottle containing mineral water or any other type of drink instead of a cap and enables the user to drink the content inside the bottle with their mouth contacting the bottle or to take in the content using a straw, and which comprises an adapter that can be mounted regardless of the diameter of the bottle entrance.

28 Claims, 11 Drawing Sheets

WEANING CLIP

TECHNICAL FIELD

The embodiment relates to a weaning clip and, more particularly, to a weaning clip which may be used not only by infants or handicapped people, but also by all people, which is mounted on a bottle containing mineral water or any other types of drinks instead of a cap and enables the user to drink the content inside the bottle with his mouth contacting the bottle or through a straw, and which includes an adapter that may be mounted without regard to the diameter of a bottle entrance.

BACKGROUND ART

In general, various kinds of beverage bottles having a straw function for infants and children have been sold. Since a straw is fixed to the drinking bottle according to the related art, the straw is not easily separated from a body of the drinking bottle even though the straw is a separable straw, so that it is difficult to wash the straw. In addition, even though the straw is separated from the bottle so that it is possible to wash the straw, it is difficult to wash cleanly the thin and long inside of the straw.

Thus, straw cases provided to the neck of a drinking bottle had been disclosed in Japanese Unexamined Patent Publication No. Pyung 11-240550 and Japanese Unexamined Patent Publication No. 2003-54601, respectively. The straw case is connected to the straw of the case body such that a predetermined straw, which is provided together with a product in the state that a case body having a cap and a straw is mounted on the neck of a beverage bottle instead of the cap of the beverage bottle, is provided in the bottle, so that it is possible to allow infants and children to easily drink beverages and at the same time, to wash or sterilize the case body separated from the beverage bottle for hygienic use.

However, according to the straw case according to the related art, since the coupling unit having a thread to allow the case body to be mounted on the neck of the beverage bottle has a size corresponding to the size of the neck of a specific beverage bottle, when infants and children desire to drink beverages of a bottle having a different bottle neck, it is difficult to apply the straw case to the corresponding beverage bottle.

Thus, an adapter for a straw case, which is capable of easily applying the straw case even to two different types of bottle necks since the outer diameter of a bottle neck or the inner diameter of a cap of a twist type of beverage bottle commercially sold in the market is 28 mm or 30 mm, had been disclosed in Korean Utility Model Registration No. 20-0464831.

However, even in Korean Utility Model Registration No. 20-0464831, since the straw is fixed to an upper portion of the case and is mounted on a lower portion of the case, the use of the straw is limited according to the length of a bottle. In addition, although the bottle necks have various sizes, it can be used for only the bottle having a diameter of 28 mm or 30 mm. Further, since it is not used without any straws, infants unable to use the straw cannot use it.

DISCLOSURE

Technical Problem

To solve the above described problems, an object of the embodiment is to provide a weaning clip which is capable of using a straw commercially used in the related art without adjusting a length of the straw.

Another object of the embodiment is to provide a weaning clip which is capable of allowing a user to drink the content in a bottle with his mouth contacting the bottle without using any straws and of preventing the content in a bottle from flowing out therefrom even when the bottle falls down, so that the weaning clip may be useful to infants or patients.

Technical Solution

To solve the above described problems, according to the embodiment, there is provided a weaning clip which is coupled to a bottle. The weaning clip includes: a cap assembly including opened upper and lower portions, an outer surface formed in a cylindrical shape or formed in a polygonal shape having a wide upper portion and a narrow lower portion, an inner surface formed in a cylindrical shape or formed to have a wide upper portion and a narrow lower portion in a same manner as the outer surface, a support plate formed in a shape of a hollow disk and connected to the inner surface, a support leg coupling ledge formed on a lower surface of the support plate in a shape of a hollow cylinder having a diameter equal to an inner diameter of the support plate, a bottle coupling support formed in a shape of a hollow cylinder having a diameter larger than the diameter of the support leg coupling ledge and smaller than a diameter of the outer surface, a plurality of holes formed between the support leg coupling ledge and the bottle coupling support, and a thread formed along an inner surface of a lower portion, a support unit formed in a shape of a hollow disk on the upper surface of the support plate, wherein the support unit includes at least two support legs protruding from a lower surface in a lower proceeding direction, and latching protrusions protruding from each one side of outer surfaces of the support legs at a center in a diameter direction such that the latching protrusions are fitted into a lower surface of the support leg coupling ledge; and a pad unit covering an upper inner surface of the cap assembly, and including a support leg through-hole which is formed at a central portion and fitted with the support legs to be coupled to the support unit by allowing the support legs to pass through the support leg through-hole from above to below, in an upper-to-lower direction.

The pad unit includes an X or I-shaped straw inserting hole formed at a central portion of the pad unit such that a straw is inserted through the straw inserting hole.

The pad unit includes a central pad placed at an inside of the support unit on the basis of the support, and a peripheral pad placed at an outside of the support unit on the basis of the support, and wherein the central pad is detachably attached to the support unit.

In this case, the pad unit further includes a central pad coupling protrusion which protrudes from an inner side surface of the support unit toward a center of the support unit such that the central pad is fitted with the central pad coupling protrusion.

In addition, the weaning clip further includes a straw assembly which includes a straw and a straw support having a shape of a hollow cylinder and a groove formed on an outer side surface of the straw support while surrounding one side surface of an outside of the straw, such that the straw support is fitted with the central pad coupling protrusion instead of the central pad.

In this case, the pad unit further includes a cap unit of a cap type, which has an inner diameter corresponding to a diameter of an upper outer surface of the cap assembly, a closed upper portion and an openable lower portion, such that the cap unit covers an upper portion of the cap assembly.

In addition, the hand unit includes a thread formed on an inner side surface thereof corresponding to a thread formed on a lower portion of an outer side surface of the cap assembly, such that the hand unit s screw-coupled to the cap assembly.

In addition, the hand unit includes a handle unit which is coupled to a lower portion of an outer side surface of the cap assembly and includes a body having a hollow cylindrical shape and at least one handle bent to be curved downwardly and outwardly from one side of the body, wherein the hand unit includes a thread formed on an inner side surface thereof corresponding to a thread formed on a lower portion of an outer side surface of the cap assembly, such that the hand unit s screw-coupled to the cap assembly.

The weaning clip further includes a cap unit of a cap type, which has an inner diameter corresponding to a diameter of an upper outer surface of the cap assembly, a closed upper portion and an openable lower portion, such that the cap unit covers an upper portion of the cap assembly.

In this case, the weaning clip further includes an adapter which is formed in a hollow cylindrical shape and has a thread formed on an upper portion of an outer side surface corresponding to the thread formed on the inner side surface of the lower portion of the cap assembly and a thread formed on a lower portion of an inner side surface corresponding to the thread formed on an outer side surface of an entrance of a bottle.

In addition, the lower portion of the inner side surface of the adapter has a diameter corresponding to an outer diameter of the entrance of the bottle.

Advantageous Effects

According to the embodiment, a disposable straw commercially used in the related art itself may be used without adjusting a length of the disposable straw and limitation in size.

In addition, according to the embodiment, a user may drink the content in a bottle with his mouth contacting the bottle without using any straws and the content in a bottle may be prevented from flowing out therefrom even when the bottle falls down so that the weaning clip is useful to infants or patients.

BEST MODE

Mode for Invention

Hereinafter, the embodiment will be described in detail with reference to accompanying drawings.

Figure 1:
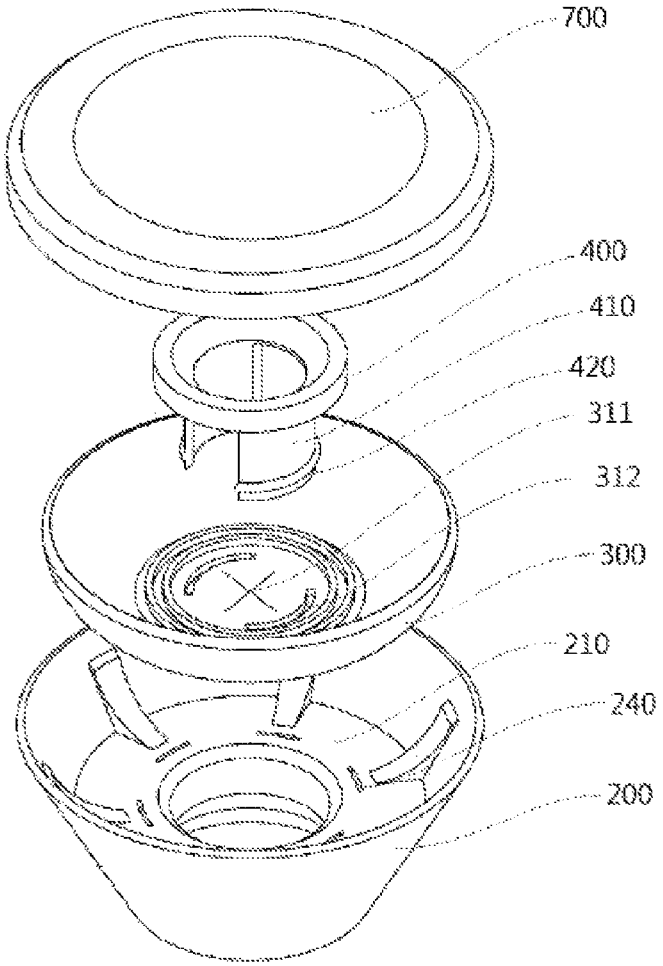
FIG. 1 is an exploded perspective view showing a weaning clip of a circular-pad type according to one embodiment.
Figure 2:
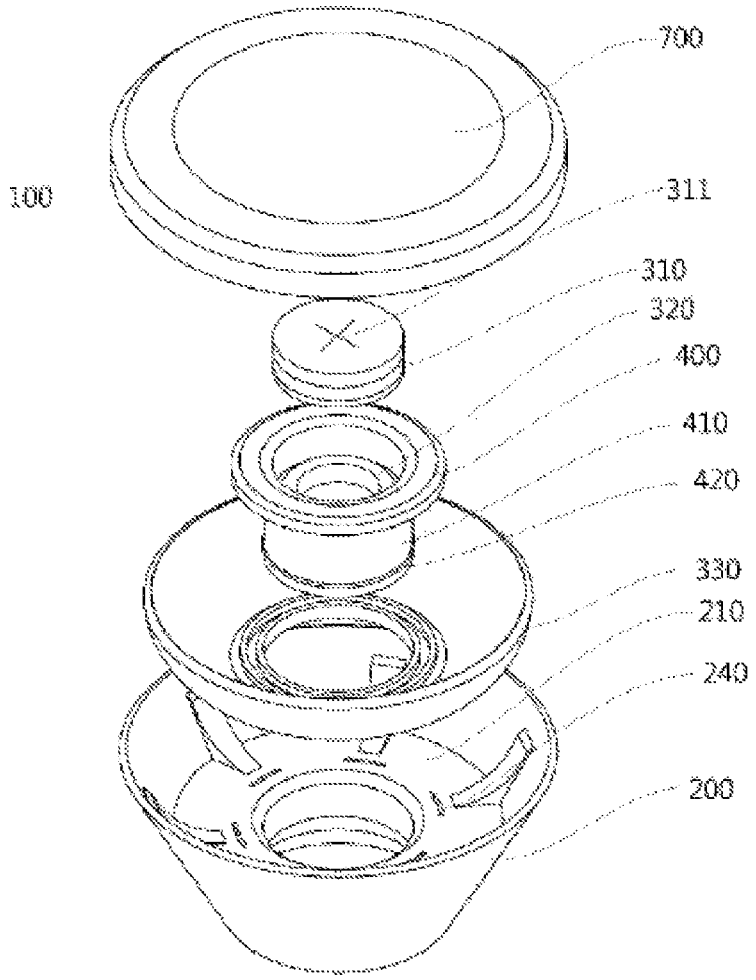
FIG. 2 is an exploded perspective view showing a weaning clip of a two-pad type according to one embodiment.
Figure 3:
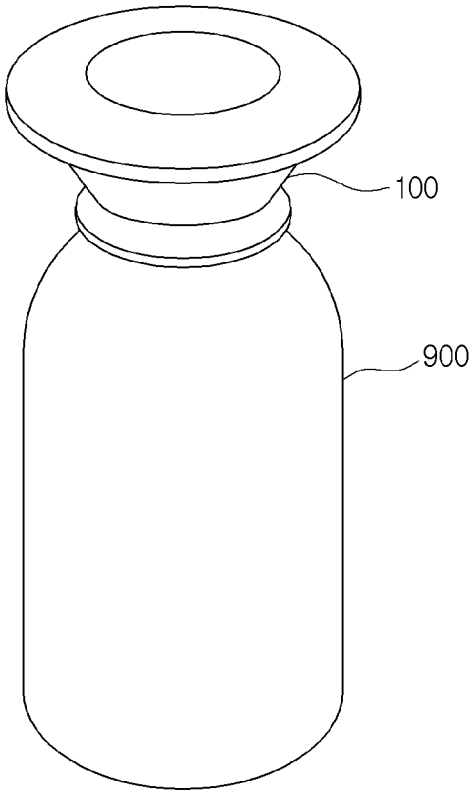
FIG. 3 is a perspective view showing a weaning clip coupled to a bottle according to one embodiment.
Figure 4:
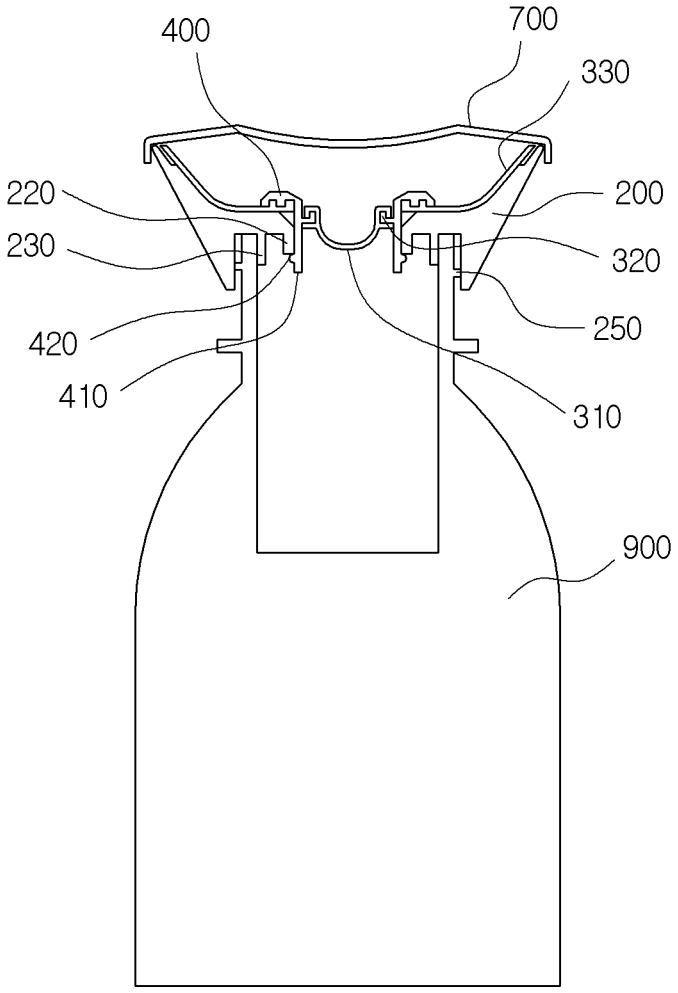
FIG. 4 is a sectional view showing a weaning clip of a two-pad type according to one embodiment.
Figure 5:
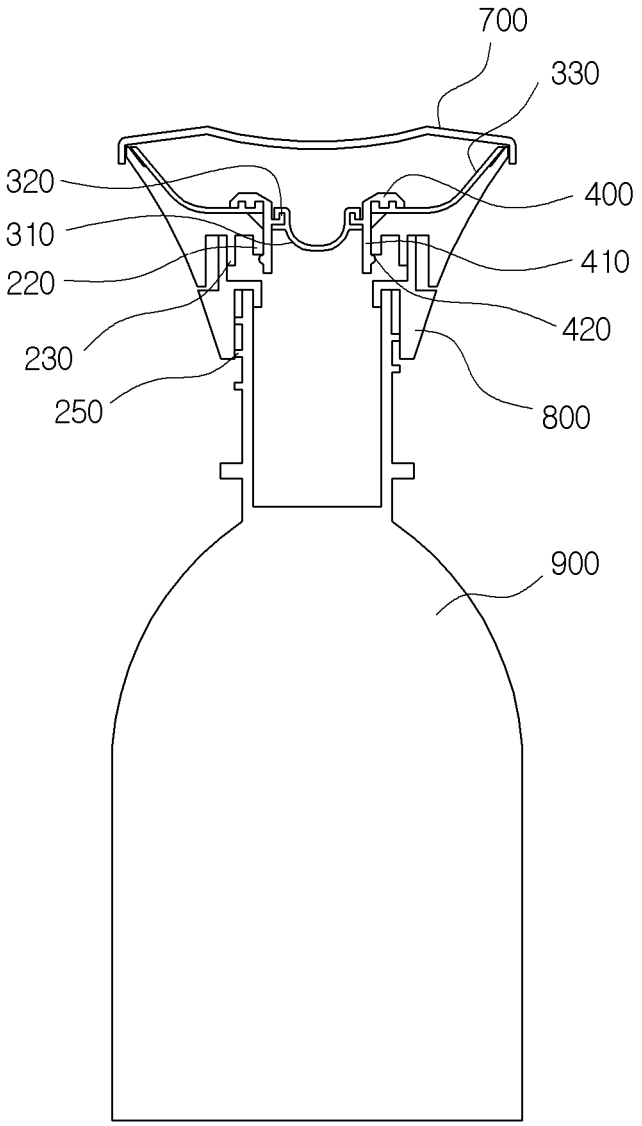
FIG. 5 is a sectional view showing a weaning clip to which an adapter is added according to one embodiment.
Figure 6:
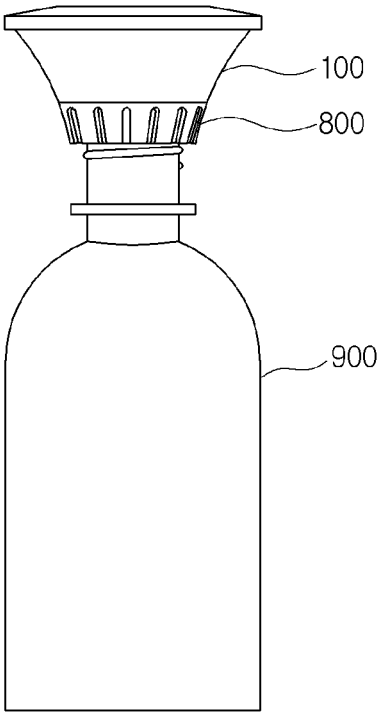
FIG. 6 is a front view showing a weaning clip to which an adapter is added according to one embodiment.
Figure 7:
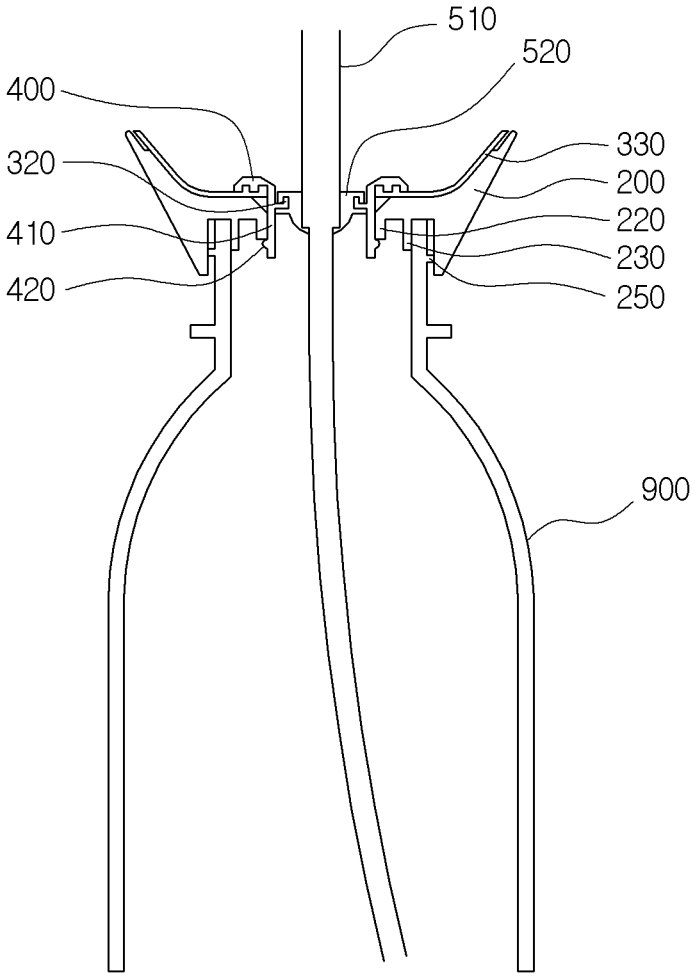
FIG. 7 is a sectional view showing a weaning clip to which a straw assembly is coupled according to one embodiment.
Figure 8:
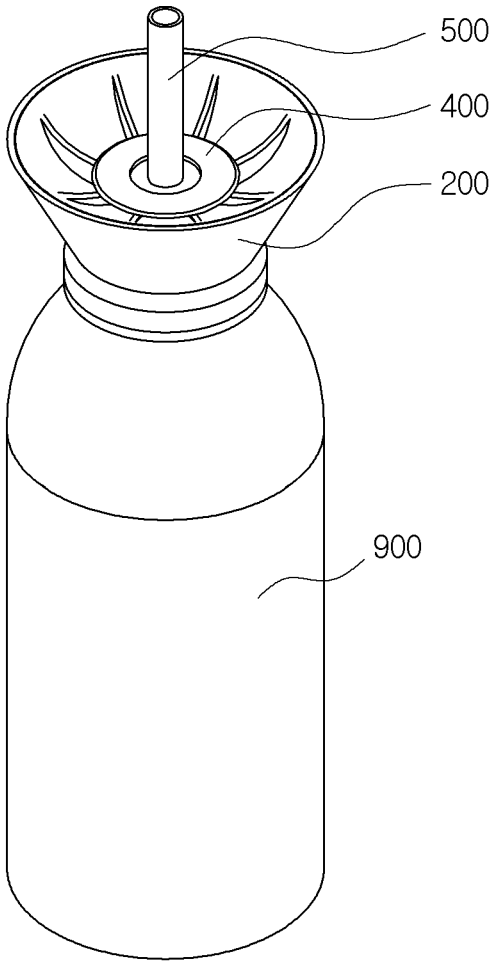
FIG. 8 is a perspective view showing a weaning clip to which a straw assembly is coupled according to one embodiment.
Figure 9:
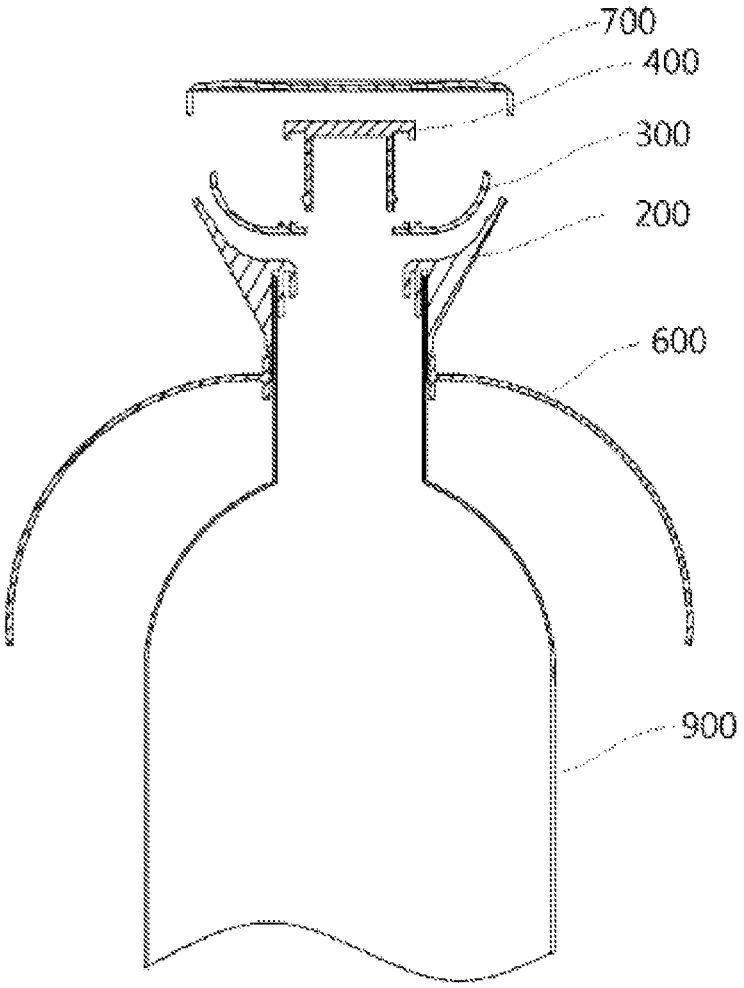
FIG. 9 is a sectional view showing a weaning clip to which an integral handle unit is coupled according to one embodiment.
Figure 10:
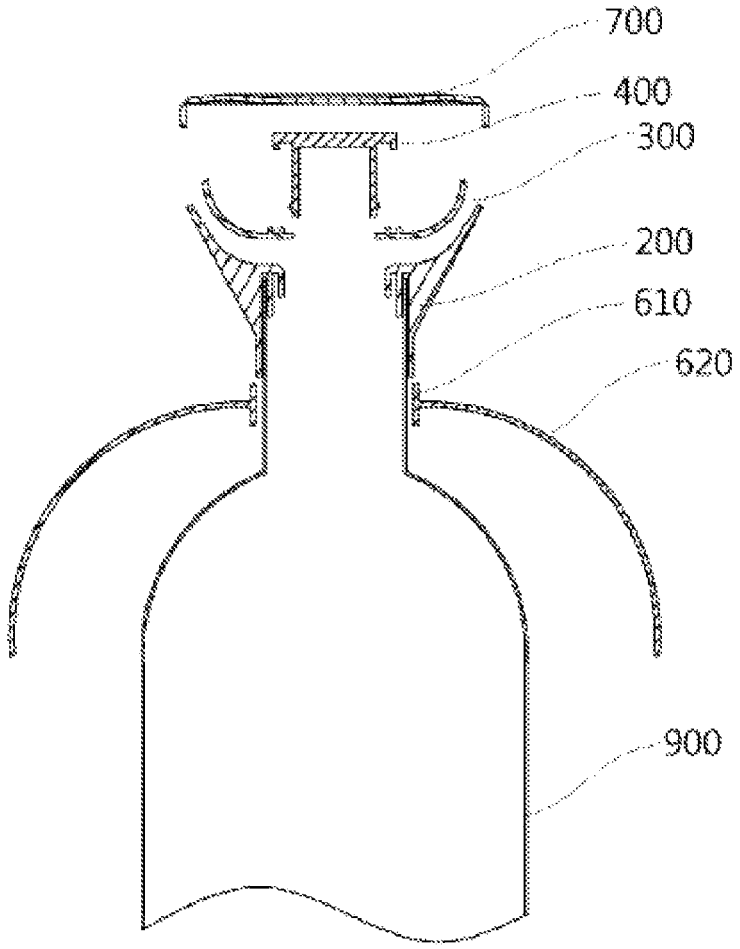
FIG. 10 is a sectional view showing a weaning clip to which a separated handle unit is coupled according to one embodiment.

FIG. 1 is an exploded perspective view showing a weaning clip of a circular-pad type according to one embodiment. FIG. 2 is an exploded perspective view showing a weaning clip of a two-pad type according to one embodiment. FIG. 3 is a perspective view showing a weaning clip coupled to a bottle according to one embodiment. FIG. 4 is a sectional view showing a weaning clip of a two-pad type according to one embodiment. FIG. 5 is a sectional view showing a weaning clip to which an adapter is added according to one embodiment. FIG. 6 is a front view showing a weaning clip to which an adapter is added according to one embodiment. FIG. 7 is a sectional view showing a weaning clip to which a straw assembly is coupled according to one embodiment. FIG. 8 is a perspective view showing a weaning clip to which a straw assembly is coupled according to one embodiment. FIG. 9 is a sectional view showing a weaning clip to which an integral handle unit is coupled according to one embodiment. FIG. 10 is a sectional view showing a weaning clip to which a separated handle unit is coupled according to one embodiment.

Referring to FIGS. 1 to 10, a weaning clip, which may be coupled to a bottle to be used, includes: a cap assembly 200 which includes opened upper and lower portions, an outer surface formed in a cylindrical shape or formed in a polygonal shape having a wide upper portion and a narrow lower portion, an inner surface formed in a cylindrical shape or formed to have a wide upper portion and a narrow lower portion in the same manner as the outer surface, a support plate 210 formed in a shape of a hollow disk and connected to the inner surface, a support leg coupling ledge 220 formed on a lower surface of the support plate 210 in a shape of a hollow cylinder having a diameter equal to an inner diameter of the support plate 210, a bottle coupling support 230 formed in a shape of a hollow cylinder having a diameter larger than the diameter of the support leg coupling ledge 220 and smaller than a diameter of the outer surface, a plurality of holes 240 formed between the support leg coupling ledge 220 and the bottle coupling support 230, and a thread 250 formed along the inner side surface of a lower portion thereof; a support unit 400 formed in a shape of a hollow disk on the upper surface of the support plate 210, wherein the support unit includes at least two support legs 410 protruding from a lower surface thereof in a lower proceeding direction, and latching protrusions 420 protruding from each one side of outer surfaces of the support legs 410 at a center in a diameter direction such that the latching protrusions 420 are fitted into a lower surface of the support leg coupling ledge 220; and a pad unit 300 covering an upper inner surface of the cap assembly 200, and including a support leg through-hole 312 which is formed at a central portion thereof and fitted with the support legs 410 to be coupled to the support unit 400 by allowing the support legs 410 to pass through the support leg through-hole 312 from above to below, in an upper-to-lower direction.

In this case, the support unit 400 may not be fitted with the pad unit 300 and the pad unit may be tightly fixed to the cap assembly 200. To this end, the pad unit 300 may be further formed with a contact portion which may allow the pad unit 300 not only to cover an upper side surface of the cap assembly 200, but also to be tightly fixed to the inner side surface of the support leg coupling ledge 220, so that the pad unit 300 and the support unit 400 separated from each other may be tightly fixed to the cap assembly like a single component.

In addition, an X or I-shaped straw inserting hole 311 is formed at the central portion of the pad unit 300 such that a disposable straw may be inserted through the straw inserting hole 311.

To use the weaning clip 100, a user allows the cap assembly 200 to be screw-coupled to the thread 250 formed at the entrance of a PET bottle 900. After the cap assembly 200 is coupled to the PET bottle 900, even when the PET bottle 900 turns over or falls down, the content in the PET bottle 900 does not flow out. The reason is because of the pad unit 300 covering the upper inner surface of the cap assembly 200. The pad unit 300 made of a flexible elastic material is attached closely to the upper inner surface of the cap assembly 200. Thus, even when the PET bottle 900 turns over or falls down, the content in the PET bottle 900 does not flow out.

The PET bottle 900 is inclined to drink the content in the PET bottle 900 coupled to the weaning clip 100. Then, the content in the PET bottle 900 flows out through a plurality of holes 240 formed between the support leg coupling ledge 220 and the bottle coupling support 230. However, the pad unit 300 still covers the upper inner surface of the cap assembly 200 so that the content is prevented from flowing out. Therefore, the user takes additional action to drink the content.

As the user takes additional action, after his upper lip is placed on the pad unit 300 and his lower lip is placed on the outer surface of the cap assembly 200, the user sucks the pad unit 300 while closing his mouth and pressing the pad unit 300. In this case, since the pad unit 300 is flexible, when the upper lip presses one side of the pad unit 300, although the pressed portion is tightly closed to the cap assembly 200, portions around the pressed portion make a gap, so that the content flows out through the gap. In addition, if the pad unit 300 is rapidly pulled, the content may be drunk more easily.

In addition, when the lips are separated after the drinking is completed, the pad unit 300 covers the upper inner surface of the cap assembly 200 again to fill the gap, so that the content in the PET bottle 900 is prohibited from flowing out again.

In order to drink more conveniently the content in the PET bottle 900, a disposable straw may be used. General disposable straws can be used without limitation. If a common disposable straw is inserted into the X or I-shaped straw inserting hole 311 formed on the central portion of the pad unit 300, the preparation is completed. Then, the user drinks the content by using the disposable straw. When the straw inserting hole 311 has a thin thickness, the sealing may be somewhat deteriorated, so that the content may flow out when the PET bottle 900 falls down or turns over. Thus, it is preferable that the straw inserting hole 311 is thickly formed.

In case of a straw case according to the related art, it is inconvenient to cut the disposable straw corresponding to a depth of the PET bottle 900 for use, but, according to the embodiment, since the disposable straw passes vertically through the straw inserting hole 311 for use, the embodiment may be implemented regardless of the size of the disposable straw. After the disposable straw is inserted corresponding to the depth of the PET bottle 900, the disposable straw may be conveniently used as it is.

Generally, when the embodiment is used outdoors or even indoors, a number of disposable straws may be used so that environment may be contaminated. Therefore, it may be preferable to use a silicon straw 510 instead of the disposable straw indoors. Since it is not easy to wash the straw 510 used once outdoors, the disposable straw may be used. However, the straw 510 may be readily washed and sterilized indoors so that the straw 510 may be hygienically used. Thus, the embodiment also proposes the scheme of dividing the pad part 300 into two parts.

The pad unit 300 includes a central pad 310 placed at an inside of the support unit 400 on the basis of the support 400, and a peripheral pad 330 placed at an outside of the support unit 400 on the basis of the support 400, where the central pad 310 is detachably attached to the support unit 400 and provided with the X or I-shaped straw inserting hole formed thereto, through which a disposable straw can be inserted.

In this case, the pad unit 300 further includes a central pad coupling protrusion 320 which protrudes from an inner side surface of the support unit 400 toward the center of the support unit 400 such that the central pad 310 may be fitted with the central pad coupling protrusion 320.

In addition, a straw assembly 500, which includes the straw and a straw support 520 having a groove formed on an outer side surface thereof while surrounding one side surface of an outside of the straw, is further included, such that the straw support 520 may be fitted with the central pad coupling protrusion 320 instead of the central pad 310.

The pad unit 300 is divided into two parts, that is, the central pad 310 and the peripheral pad 330. The central pad 310 is detachably fitted with the central pad coupling protrusion 320 formed in the support unit 400. The peripheral pad 330 is placed at the same position in the pad unit 300 and has the same function while being fixed by the support unit 400.

Even though the pad unit 300 is divided into two parts, a user can drink in the same manner by using the weaning clip 100. A user can drink by sucking the disposable straw after inserting the disposable straw into the straw inserting hole 311 formed on the central pad 310.

The straw assembly 500 includes the straw 510 and the straw support 520 having a groove which allows the straw 510 to be fitted with the central pad coupling protrusion 320. The central pad coupling protrusion 320 is inserted into the straw support 520, so that the straw 510 is fixed and the straw support 520 is formed of an elastic material so that the content in the PET bottle 900 is prevented from flowing out between the straw assembly 500 and the support unit 400.

In addition, a handle unit 600 is further included such that the infants or handicapped people who cannot easily y hold the PET bottle 900 easily use the weaning clip 100 when the weaning clip 100 is used.

The handle unit 600 may be formed integrally with the weaning clip 100 or may be screw coupled to the thread formed on the entrance of the PET bottle 900 as a separated type.

The handle unit 600 is coupled to a lower portion of an outer side surface of the cap assembly 200 such that the hand unit 600 is integrated with the weaning clip 100. The handle unit 600 includes a body 610 having a hollow cylindrical shape and at least one handle 620 bent to be curved downwardly and outwardly from one side of the body 610. The hand unit 600 has a thread 250 formed on an inner side surface thereof corresponding to the thread 250 formed on a lower portion of an outer side surface of the cap assembly 200, so that the hand unit 600 is screw-coupled to the cap assembly 200.

In addition, when the handle unit 600 is configured separately from the cap assembly 200, the handle unit 600 is placed between the cap assembly 200 and the entrance of the bottle 900 and includes the body 610 having a hollow cylindrical shape and at least one handle 620 bent to be curved downwardly and outwardly from one side of the body 610. The thread 250 is formed on the inner surface of the body 610 corresponding to the thread 250 of the entrance of the PET bottle 900, so that the handle unit 600 is screw-coupled to the entrance of the PET bottle 900.

In this case, although, the handle unit 600 is screw-coupled to the cap assembly 200 when the handle unit 600 is of an integral type and to the entrance of the Pet bottle 900 when the handle unit 600 is of a separated type, it is possible that the handle unit 600 is fitted with the cap assembly 200 or the entrance of the PET bottle 900.

Additionally, a cap type of a cap unit 700 is further included, which has an inner diameter corresponding to the diameter of an upper outer surface of the cap assembly 200, a closed upper portion and an openable lower portion, such that the cap unit 700 may cover an upper portion of the cap assembly 200. The cap unit 700 is used to protect the pad unit 300 from dust or foreign substances when the weaning clip 100 is not used. Although it is possible to separate the pad unit 300 from the cap assembly 200 and the support unit to separately wash the pad unit 300, in order to maintain the clean state for a long time in environment such as outdoors at which it is difficult to wash the pad unit 300, it is preferable to allow the cap unit 700 to cover the cap assembly 200 to maintain the pad unit in a clean state.

In addition, generally, an entrance size of the PET bottle 900 used in Korea is classified into three types or more. Since it may be inconvenient to carry the weaning clip 100 if the weaning clip 100 is made according to the size of the PET bottle 100, the diameter of an inner lower portion of the cap assembly 200 is configured to correspond to the entrance size of the biggest PET bottle 900. In case of the PET bottle 900 having a smaller entrance size than that of the biggest PET bottle 900, the cap assembly 200 further includes an adapter 800 which is formed in a hollow cylindrical shape and has a thread 250 formed on an upper portion of an outer side surface thereof corresponding to the thread 250 formed on an inner side surface of a lower portion of the cap assembly 200 and a thread 250 formed on a lower portion of an inner side surface thereof corresponding to the thread 250 formed on an outer side surface of the entrance of the PET bottle 900.

The adapter 800 may be formed to correspond to each size of various kinds of PET bottles 900 having mutually different diameters. In addition, a lower portion of the inner surface of the adapter 800 may be formed of an elastic material instead of the thread 250 such that the adapter 800 is detachable from the glass bottle 900.

As described above, the cap assembly 200, the pad unit 300 and the support unit 400 of the weaning clip 100 are able to be separated from and coupled to each other, so that it is possible to easily wash the weaning clip 100, thereby maintaining always the weaning clip 100 in a clean state in use. The coupling sequence is as follows. The support leg 410 of the support unit 400 is inserted into the support leg through-hole 312 and then, the latching protrusion 420, which is formed at one side of the support leg 410 of the support unit 400, is coupled to the support leg coupling ledge 220 of the cap assembly 200 through fitting. The separation is performed in the reverse sequence.

In addition, the weaning clip 100 is individually coupled to the straw assembly 500, the handle unit 600, the cap unit 700 and the adapter by the selection of a user if necessary.

Figure 11:
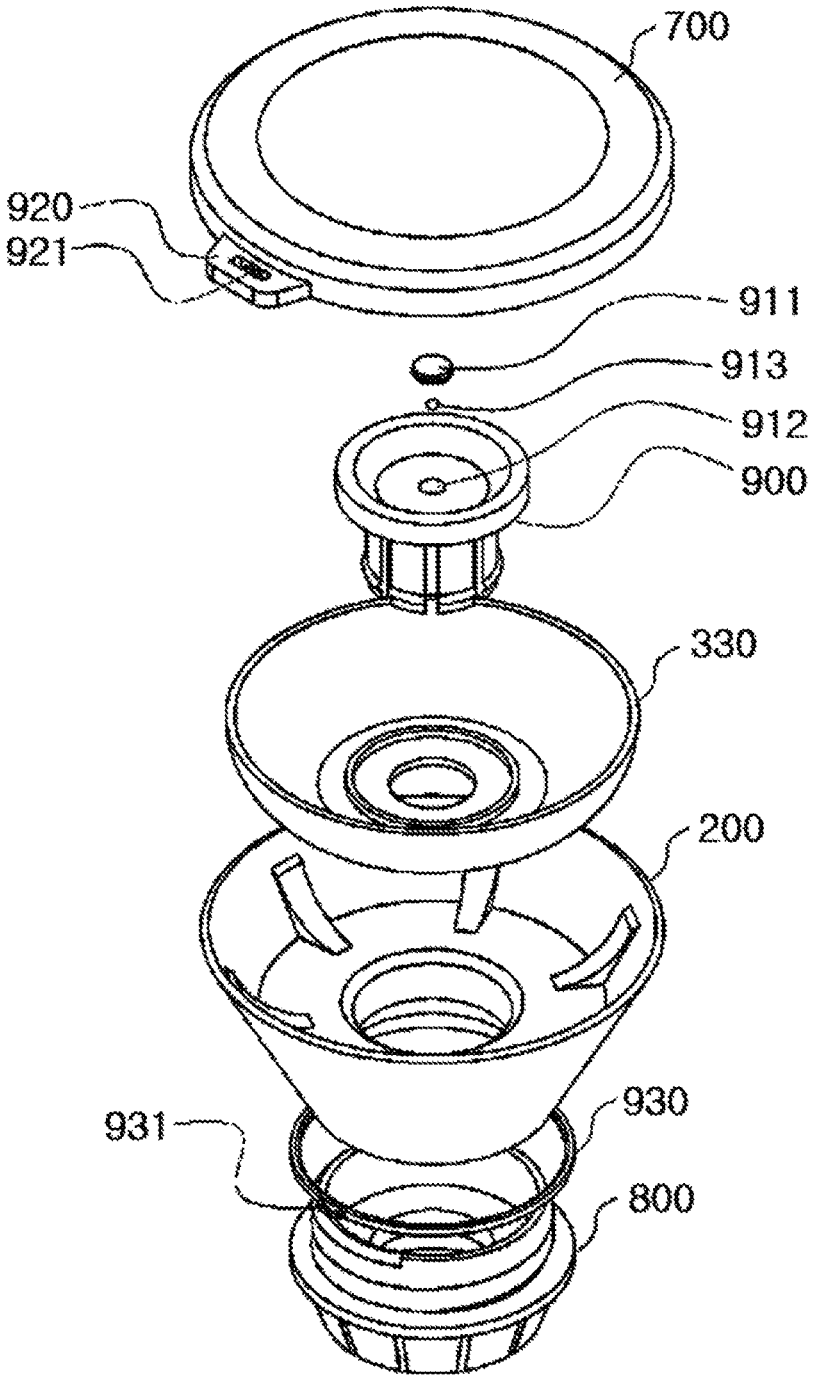
FIG. 11 is an exploded perspective view showing a weaning clip according to another embodiment.

Hereinafter, a ball pad support unit 910, latching device 920 and a latching unit 930 will be described with reference to FIG. 11.

The support unit 400 and the central pad 310 are replaced by the ball pad support unit 910 for preventing water or beverages in the PET bottle 900 from flowing out. The ball pad support unit 910 basically has an appearance similar to that of the support unit 400 described above. Similarly to the support unit 400, the ball pad support unit 910 includes the support leg and the latching protrusion 921 and has a shape of a hollow disk of which the upper portion is closed. In this case, the ball pad support unit 910 includes a groove 912 formed by digging the upper portion downwardly at a predetermined depth, at least one through-hole formed on a side surface of a lower surface of the groove 912 such that air flows through the through-hole, a ball 913 having an outer diameter corresponding to an inner diameter of the groove 912 to prevent water or beverages in the PET bottle 900 from flowing out to an outside, and a cover 911 for preventing the ball 913 from escaping upwardly from the groove 912 by covering the upper portion of the groove 912.

The latching device 920 is further provided to one side of the side surface of the cap assembly 700. An inner portion of the latching device 920 is perforated and a latching protrusion 921 is formed toward the inner portion of the latching device 920. In order to effectively keep the cap unit 700 provided with the latching device 920, a latching unit 930 is further provided between the cap assembly 200 and the adapter 800 in a ring shape. The latching unit 930 has an inner diameter corresponding to an outer diameter of the adapter 800 and a latching groove 931 formed by perforating a portion protruding from one portion of a side surface of the latching unit 930 to be fitted with the latching protrusion 921.

When the water or beverages in the PET bottle 900 is drunk by using the pad unit 300 and the straw assembly 500 after stripping the cap unit 700, the cap unit 700 is reserved by fitting the cap unit 700 with the latching unit 930.

Although exemplary embodiments have been described for illustrative purposes with reference to the accompanying drawings, the embodiments have not been described for limiting purposes. Therefore, those skilled in the art will appreciate that various modifications, additions and substitutions are possible, without departing from the scope and spirit of the invention as disclosed in the accompanying claims.

INDUSTRIAL APPLICABILITY

According to the embodiment, a user may drink the content in a bottle with his mouth contacting the bottle without using any straws and the content in a bottle may be prevented from flowing out even when the bottle falls down, so that the weaning clip may be useful to infants or patients.

The invention claimed is:

1. A weaning clip which is coupled to a bottle, the weaning clip comprising:

a cap assembly including opened upper and lower portions, an outer surface formed in a cylindrical shape or formed in a polygonal shape having a wide upper portion and a narrow lower portion, an inner surface formed in a cylindrical shape or formed to have a wide upper portion and a narrow lower portion in a same manner as the outer surface, a support plate formed in a shape of a hollow disk and connected to the inner surface, a support leg coupling ledge formed on a lower surface of the support plate in a shape of a hollow cylinder having a diameter equal to an inner diameter of the support plate, a bottle coupling support formed in a shape of a hollow cylinder having a diameter larger than the diameter of the support leg coupling ledge and smaller than a diameter of the outer surface, a plurality of holes formed between the support leg coupling ledge and the bottle coupling support, and a thread formed along the inner surface of the lower portion of the cap assembly, a support unit formed in a shape of a hollow disk on an upper surface of the support plate, wherein the support unit includes at least two support legs protruding from a lower surface in a lower proceeding direction, and latching protrusions protruding from each one side of outer surfaces of the support legs at a center in a diameter direction such that the latching protrusions are fitted into a lower surface of the support leg coupling ledge; and a pad unit covering an upper inner surface of the cap assembly, and including a support leg through-hole which is formed at a central portion and fitted with the support legs to be coupled to the support unit by allowing the support legs to pass through the support leg through-hole in an upper-to-lower direction.

2. The weaning clip of claim 1, wherein the pad unit includes an X or I-shaped straw inserting hole formed at a central portion of the pad unit such that a straw is inserted through the straw inserting hole.

3. The weaning clip of claim 1, wherein the pad unit includes a central pad placed at an inside of the support unit on the basis of the support, and a peripheral pad placed at an outside of the support unit on the basis of the support, and wherein the central pad is detachably attached to the support unit.

4. The weaning clip of claim 3, where the central pad includes an X or I-shaped straw inserting hole formed on a central portion of the central pad, such that a straw is enabled to be inserted through the X or I-shaped straw inserting hole.

5. The weaning clip of claim 3, wherein the pad unit further includes a central pad coupling protrusion which protrudes from an inner side surface of the support unit toward a center of the support unit such that the central pad is fitted with the central pad coupling protrusion.

6. The weaning clip of claim 5, further comprising a straw assembly which includes a straw and a straw support having a shape of a hollow cylinder and a groove formed on an outer side surface of the straw support while surrounding one side surface of an outside of the straw, such that the straw support is fitted with the central pad coupling protrusion instead of the central pad.

7. The weaning clip of claim 1, further comprising a cap unit, which has an inner diameter corresponding to a diameter of an upper outer surface of the cap assembly, a closed upper portion and an openable lower portion, such that the cap unit covers an upper portion of the cap assembly.

8. The weaning clip of claim 1, further comprising an adapter which is formed in a hollow cylindrical shape and has a thread formed on an upper portion of an outer side surface corresponding to the thread formed on the inner side surface of the lower portion of the cap assembly and a thread formed on a lower portion of an inner side surface corresponding to the thread formed on an outer side surface of an entrance of a bottle.

9. The weaning clip of claim 8, wherein the lower portion of the inner side surface of the adapter has a diameter corresponding to an outer diameter of the entrance of the bottle.

10. The weaning clip of claim 1, further comprising a handle unit which is coupled to a lower portion of an outer side surface of the cap assembly and includes a body having a hollow cylindrical shape and at least one handle bent to be curved downwardly and outwardly from one side of the body.

11. The weaning clip of claim 10, wherein the hand unit includes a thread formed on an inner side surface thereof corresponding to a thread formed on a lower portion of an outer side surface of the cap assembly, such that the hand unit is screw-coupled to the cap assembly.

12. The weaning clip of claim 1, further comprising a handle unit which is coupled to a lower portion of an outer side surface of the cap assembly and includes a body having a hollow cylindrical shape and at least one handle bent to be curved downwardly and outwardly from one side of the body, wherein the hand unit includes a thread formed on an inner side surface thereof corresponding to a thread formed on a lower portion of an outer side surface of the cap assembly, such that the hand unit is screw-coupled to the cap assembly.

13. The weaning clip of claim 10, further comprising a cap unit, which has an inner diameter corresponding to a diameter of an upper outer surface of the cap assembly, a closed upper portion and an openable lower portion, such that the cap unit covers an upper portion of the cap assembly.

14. The weaning clip of claim 10, further comprising an adapter which is formed in a hollow cylindrical shape and has a thread formed on an upper portion of an outer side surface corresponding to the thread formed on the inner side surface of the lower portion of the cap assembly and a thread formed on a lower portion of an inner side surface corresponding to the thread formed on an outer side surface of an entrance of a bottle.

15. The weaning clip of claim 14, wherein the lower portion of the inner side surface of the adapter has a diameter corresponding to an outer diameter of the entrance of the bottle.

16. The weaning clip of claim 12, further comprising a cap unit, which has an inner diameter corresponding to a diameter of an upper outer surface of the cap assembly, a closed upper portion and an openable lower portion, such that the cap unit covers an upper portion of the cap assembly.

17. The weaning clip of claim 12, further comprising an adapter which is formed in a hollow cylindrical shape and has a thread formed on an upper portion of an outer side surface corresponding to the thread formed on the inner side surface of the lower portion of the cap assembly and a thread formed on a lower portion of an inner side surface corresponding to the thread formed on an outer side surface of an entrance of a bottle.

18. The weaning clip of claim 17, wherein the lower portion of the inner side surface of the adapter has a diameter corresponding to an outer diameter of the entrance of the bottle.

19. The weaning clip of claim 3, wherein the support unit and the central pad are replaced by a ball pad support unit for preventing water in the bottle from flowing out.

20. The weaning clip of claim 7, further comprising a latching device having a latching protrusion which protrudes from one side surface of the cap assembly in a radial direction to be formed toward the inner portion of the latching device and an inner portion of which is perforated.

21. The weaning clip of claim 20, further comprising an adapter which is formed in a hollow cylindrical shape and has a thread formed on an upper portion of an outer side surface corresponding to the thread formed on the inner side surface of the lower portion of the cap assembly and a thread formed on a lower portion of an inner side surface corresponding to the thread formed on an outer side surface of an entrance of a bottle.

22. The weaning clip of claim 21, further comprising a latching unit provided between the cap assembly and the adapter in a ring shape, wherein the latching unit has an inner diameter corresponding to an outer diameter of the adapter and a latching groove formed by perforating a portion protruding from one side surface of the latching unit such that the latching groove is fitted with the latching protrusion.

23. The weaning clip of claim 13, further comprising a latching device having a latching protrusion which protrudes from one side surface of the cap assembly in a radial direction to be formed toward the inner portion of the latching device and an inner portion of which is perforated.

24. The weaning clip of claim 23, further comprising an adapter which is formed in a hollow cylindrical shape and has a thread formed on an upper portion of an outer side surface corresponding to the thread formed on the inner side surface of the lower portion of the cap assembly and a thread formed on a lower portion of an inner side surface corresponding to the thread formed on an outer side surface of an entrance of a bottle.

25. The weaning clip of claim 24, further comprising a latching unit provided between the cap assembly and the adapter in a ring shape, wherein the latching unit has an inner diameter corresponding to an outer diameter of the adapter and a latching groove formed by perforating a portion protruding from one side surface of the latching unit such that the latching groove is fitted with the latching protrusion.

26. The weaning clip of claim 16, further comprising a latching device having a latching protrusion which protrudes from one side surface of the cap assembly in a radial direction to be formed toward the inner portion of the latching device and an inner portion of which is perforated.

27. The weaning clip of claim 26, further comprising an adapter which is formed in a hollow cylindrical shape and has a thread formed on an upper portion of an outer side surface corresponding to the thread formed on the inner side surface of the lower portion of the cap assembly and a thread formed on a lower portion of an inner side surface corresponding to the thread formed on an outer side surface of an entrance of a bottle.

28. The weaning clip of claim 27, further comprising a latching unit provided between the cap assembly and the adapter in a ring shape, wherein the latching unit has an inner diameter corresponding to an outer diameter of the adapter and a latching groove formed by perforating a portion protruding from one side surface of the latching unit such that the latching groove is fitted with the latching protrusion.

* * * * *